United States Patent [19]

Goss et al.

[11] Patent Number: 4,937,435

[45] Date of Patent: Jun. 26, 1990

[54] FLEXIBLE ELECTRIC HEATING PAD USING PTC CERAMIC THERMISTOR CHIP HEATING ELEMENTS

[75] Inventors: David C. Goss, San Marcos; Chandrakant M. Yagnik, Austin, both of Tex.

[73] Assignee: Thermon Manufacturing Company, San Marcos, Tex.

[21] Appl. No.: 324,979

[22] Filed: Mar. 15, 1989

Related U.S. Application Data

[63] Continuation of Ser. No. 132,479, Dec. 14, 1987, abandoned.

[51] Int. Cl.[5] ..... H05B 1/02; H05B 3/14; H01C 7/02

[52] U.S. Cl. ..... 219/528; 219/505; 219/535; 219/537; 219/539; 219/540; 219/542; 219/544; 219/553; 338/22 R; 338/328; 338/329

[58] Field of Search ..... 219/504, 505, 528, 530, 219/540, 541, 544, 548, 549, 552, 553, 539, 534, 535, 537, 542; 338/22 R, 210, 212, 328, 329

[56] References Cited

U.S. PATENT DOCUMENTS

| | | | |
|---|---|---|---|
| 2,278,072 | 3/1942 | Gould et al. | 338/328 |
| 3,243,753 | 3/1966 | Kohler . | |
| 3,351,882 | 11/1967 | Kohler et al. . | |
| 3,413,442 | 11/1968 | Buiting et al. . | |
| 4,017,715 | 4/1977 | Whitney et al. | 219/505 X |
| 4,037,082 | 7/1977 | Tamada et al. | 219/505 X |
| 4,045,763 | 8/1977 | Miyamoto et al. . | |
| 4,072,848 | 2/1978 | Johnson | 219/528 |
| 4,091,267 | 5/1978 | Grant | 219/505 X |
| 4,104,509 | 8/1978 | Van Bokestal et al. . | |
| 4,117,312 | 9/1978 | Johnson et al. | 219/505 X |
| 4,121,088 | 10/1978 | Doremus et al. | 219/539 X |
| 4,242,567 | 12/1980 | Carter | 219/539 X |
| 4,304,044 | 12/1981 | Lee | 219/549 |
| 4,314,231 | 2/1982 | Walty | 338/328 |
| 4,317,027 | 2/1982 | Middleman et al. | 219/548 X |
| 4,327,282 | 4/1982 | Nauerth | 219/505 X |
| 4,330,703 | 5/1982 | Horsma et al. | 219/505 X |
| 4,341,949 | 7/1982 | Steiner et al. | 219/553 X |
| 4,369,423 | 7/1983 | Holtzberg | 338/214 X |
| 4,392,051 | 7/1983 | Goss et al. | 219/528 |
| 4,401,885 | 8/1983 | Ishii et al. | 219/530 X |
| 4,426,573 | 1/1984 | Fudickar et al. | 219/544 |
| 4,445,026 | 4/1984 | Walker | 219/541 X |
| 4,485,297 | 11/1984 | Grise et al. | 219/528 |
| 4,626,666 | 12/1986 | Maeda et al. | 219/530 X |
| 4,631,391 | 12/1986 | Tiepke | 219/544 X |

FOREIGN PATENT DOCUMENTS

| | | | |
|---|---|---|---|
| 3041597 | 6/1982 | Fed. Rep. of Germany | 219/222 |
| 3042420 | 6/1982 | Fed. Rep. of Germany | 219/505 |
| 1367569 | 6/1984 | France | 219/528 |

*Primary Examiner*—Anthony Bartis

*Attorney, Agent, or Firm*—Pravel, Gambrell, Hewitt, Kimball & Krieger

[57] ABSTRACT

A flexible electric heating pad has a plurality of positive temperature coefficient (PTC) ceramic thermistor chip heating elements arranged in a two dimensional array between first and second flexible planar sheets of electrically conductive material, preferably woven of copper wire or other electrically conductive fibers. The PTC thermistor chips are disposed in spaced openings in a flexible dielectric separator disposed between the sheets and each chip has opposed planar surfaces soldered, welded or brazed to the sheets to establish electrical and thermal contact therewith. An outer flexible dielectric material covers the external surfaces of the sheets to prevent grounding or shock. A metallic enclosure, for example of stainless steel, can be formed over the outer dielectric material to add corrosion or abrasion resistance to the flexible heating pad.

8 Claims, 2 Drawing Sheets

FLEXIBLE ELECTRIC HEATING PAD USING PTC CERAMIC THERMISTOR CHIP HEATING ELEMENTS

This is a continuation of co-pending application Ser. No. 132,479 filed on Dec. 14, 1987, now abandoned.

BACKGROUND OF THE INVENTION

1. Field of the Invention

The present invention relates to electrical heating devices that use positive temperature coefficient thermistors as self-regulating heaters.

2. Description of the Prior Art

As exemplified in U.S. Pat. No. 4,072,848, electrical heating cables have been used commercially for some time to provide heat to pipes and tanks in cold environments.

Heating cables as disclosed in U.S. Pat. No. 4,072,848 based their temperature control on the use of variable resistance heating materials which provide a self-regulating feature. The heating materials are generally formed into chips made of barium titanate or solid solutions of barium and strontium titanate which are made semiconductive by the inclusion of various dopants. These chips are referred to as positive temperature coefficient thermistors and have a relatively low resistance at low temperatures. As the temperature of the thermistor rises, a sharp rise in the resistance occurs at a point termed the "Curie point". The transition from low resistivity to high resistivity occurs at a relatively sharp point as shown in U.S. Pat. No. 4,072,848. As these chips are well known to those skilled in the art, no further discussion of their construction is necessary.

As a voltage is applied to the thermistor, the thermistor generates heat due to resistance effects. This heat is then transferred to the environment, such as the pipe to which the cable is attached. As the temperature of the thermistor and the surrounding environment increases, the thermistor temperature reaches the Curie point, the heat producing capability of the thermistor is reduced and the thermistor cools down. Thus the thermistor temperature settles on or near the Curie point, with the temperature of the surrounding environment being based on the thermal conductivities of the various materials in contact with the thermistor.

Prior art thermistor-based devices were cables and other similar devices which covered only small lateral areas, even though they could be extended for long distances. While the prior art cables could be shaped in serpentine patterns to cover larger lateral areas, this often resulted in uneven temperature distributions over the surface area and was hard to manufacture.

U.S. Pat. No. 4,330,703 shows several examples of prior art cables utilizing heat generating layers of materials and having electrical conductors formed of metal sheets, grid or meshes. The heat generating materials are located over the entire area of the cable, not in discrete and separated areas as is the practice in thermistor-based cables. Additionally, the electrical conductors are thin, utilized only to supply electrical current to the heat generating materials and not utilized to conduct appreciable amounts of heat.

SUMMARY OF THE INVENTION

The heating pad of the present invention has substantially flat, planar, flexible, preferably woven, electrical conductors disposed in overlying parallel relationship and having a plurality of spaced thermistors electrically connected thereto, wherein the electrical conductors serve as the primary heat transfer means by dissipating heat produced by the thermistors away from them. The electrical conductors may be woven copper wire cloth or other woven, electrically conductive fibers. The thermistors have opposed planar surfaces in electrical and thermal contact with the electrical conductors, preferably by soldering, brazing or welding the thermistors to the electrical conductors. The thermistors are spaced in a two dimensional grid or substantially uniform pattern over the area of the heating pad with the total area of the thermistors being less than the total area of each of the electrical conductors. A flexible insulator is disposed between the electrical conductors in the area not occupied by the thermistors to prevent the electrical conductors from contacting. Such construction results in an efficient heat transfer between the conductors and the thermistors, thus allowing heat to be removed from the thermistors. Also such construction enables the thermistor to produce high power levels with a given applied voltage before the thermistor reaches the self-limiting temperature or Curie point. A flexible insulating material is provided over the external surfaces of the electrical conductors to reduce the possibilities of grounding or shock. The entire assembly is flexible or bendable for forming around vessels or pipes. An optional metallic enclosure, such as stainless steel, can be formed over the outer insulation material for corrosion resistance or mechanical abrasion resistance.

Such heat transfer using the electrical conductors improves the temperature distribution over the surface of the pad because the heat is transferred in all directions along the electrical conductors, which are good thermal conductors, and away from the thermistors, limiting the amount of local heat and improving the heat balance of the pad. The construction of a heating pad of the present invention allows ease of manufacture because complex serpentine paths are not required.

The use of the woven electrical conductors significantly decreases the thermal or mechanical stresses which occur at the connections between the conductors and thermistors because of the dispersed multidirectional forces which are exerted because of the small size and great number of wire strands in the material.

DESCRIPTION OF THE PREFERRED EMBODIMENT

Figure 1:
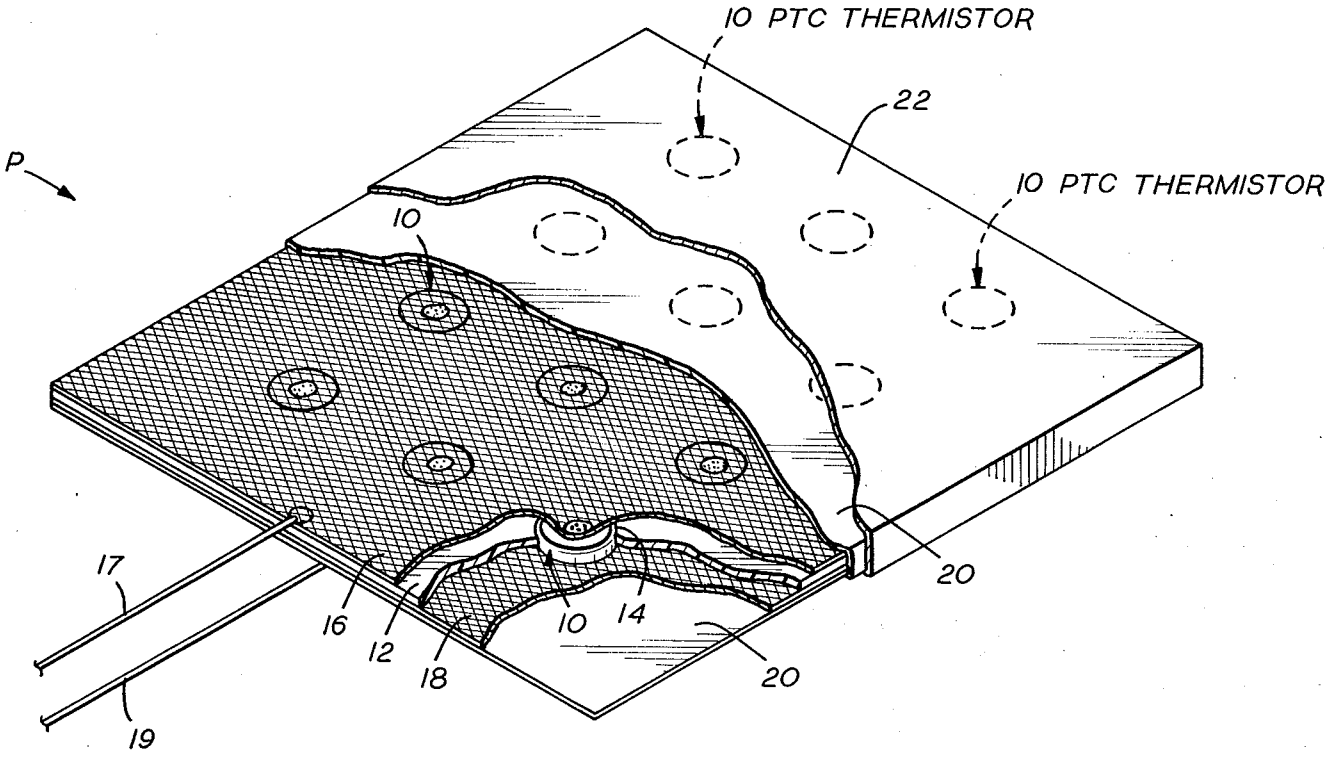
FIG. 1 is a perspective view in partial cross-section of a heating pad constructed according to the present invention.

Referring to the drawings, the letter P generally designates a heating pad according to the present invention.

FIG. 1 illustrates the preferred embodiment of a heating pad P constructed according to the present invention. A plurality of thermistors 10 are inserted into a separating dielectric insulator 12. The separating dielectric 12 contains a series of holes or cavities 14 in which the thermistors 10 are installed. The spacing between the holes 14 is varied depending upon the specific size of the thermistors 10 and the number of thermistors 10 required for a given desired thermal output of the heating pad P. Preferably the holes 14 are slightly smaller than the size of the thermistors 10 so that the thermistors 10 are positively retained in the separating dielectric 12. The thermistors 10 are shown as being circular in cross-section, but any desired shape can be used, with the holes 14 have corresponding shapes. The dielectric material may be rubber, thermoplastic resins such as polyethylene or polytetrafluoroethylene, asbestos fiber, or any satisfactory material which is an electrical insulating material and is capable of withstanding the temperatures of the thermistors 10, while conducting sufficient heat as desired and being flexible to allow the heating pad P to be flexed as desired.

Conductive sheets 16, 18 are installed parallel to each other and on opposite sides of the separating dielectric 12 to provide the source of electrical energy to be converted by the thermistors 10 to heat. The conductive sheets 16, 18 are attached to the thermistors 10 by soldering, brazing, welding or otherwise electrically and mechanically connecting the conductive sheets 16, 18 to the surfaces of the thermistors 10. Conductors 17, 19 are attached to the conductive sheets 16, 18 and to the voltage source (not shown) used to supply electrical energy to the heating pad P. After the conductive sheets 16, 18 have been connected to the thermistors 10, an insulating layer 20 is provided to protect the heating pad P from the environment. In this way, short circuit and potential shock conditions are prevented. If further mechanical or corrosion resistant protection is desired or where a more rigid surface is desired, a metallic sheath 22 can be formed over the insulating layer 20 of the heating pad P. The metallic sheath 22 may be aluminum, stainless steel, copper or any satisfactory metal or metal alloy that can be formed about the pad.

Such construction, using conductive sheets 16, 18 of adequate heat transfer capability, results in the conductive sheets 16, 18 becoming the primary heat transfer means. The use of the conductive sheets 16, 18 as the primary heat transfer means results in increased heat removal from the thermistors 10 and a more even temperature distribution over the surface of the heating pad P. Thus, by reason of this invention, heat is removed from the thermistors 10 and the heat is evenly distributed over the area of the heating pad P.

The conductive sheets 16, 18 are preferably formed of copper wire cloth approximately the same size and shape as the heating pad P. The conductive sheets 16, 18 can alternately be formed of wire cloth made of aluminum, stainless steel or other metallic conductors. Alternatively, carbon or graphite fibers, conductively coated fiberglass yarn or other similar materials of known construction as are commonly used in automotive ignition cables and as disclosed in U.S. Pat. No. 4,369,423 may be used. The fibers can be electroplated with nickel to further improve the conductivity of the fibers. Sufficient numbers of the fibers are woven to provide a conductive sheet which is capable of carrying the necessary electrical and thermal loads. In yet another alternative, the conductive sheets could be solid metallic sheets of materials such as copper, aluminum or other suitable materials. An exemplary copper cloth is comprised of 0.011 inch diameter copper wire formed into a mesh having 16 wires per inch in either direction. The individual copper strands may be coated with a tin, silver, aluminum or nickel plated finish.

The conductive sheet construction according to the present invention is preferably formed with a large number of smaller wires which are woven into sheets. The increased number of contacts of smaller wire and the mesh or woven pattern developed by the woven conductors decreases the thermal and mechanical stresses which occur at the connection between the conductive sheet 16, 18 and the thermistor 10. The thermal stresses arise due to differing expansion rates and other reasons and the mechanical stresses occur due to the flexible nature of the heating pad P. Because the woven wires are small and are arranged in several different directions, the forces exerted on each strand or wire are low, thereby increasing the reliability of the heating pad P.

A heating pad P according to the present invention can be cut or formed into almost any desired shape. The exemplary embodiment shown in FIG. 1 is formed into a square, but the heating pad P can be formed into circular shapes, irregular shapes or regular or irregular polygons as desired. Because the thermistors 10 are relatively small, and the other materials used in the present invention are preferably flexible, the heating pad P is adapted to be flexed so as to substantially conform to an item such as a vessel or pipe to be heated.

EXAMPLE

A heating pad P was constructed of copper wire cloth according to FIG. 1 with Curie temperature 124°–128° C. thermistors 10. A one foot square separating dielectric layer 12 of coated fiberglass having a thickness of 0.07 inches was used. Twelve thermistors 10 were placed in openings 14 distributed evenly over the area of the separating dielectric layer 12. Copper wire cloth having a 16 by 16 mesh and formed of 0.011 inch diameter wires was formed into sheets one foot square which were then soldered to pre-tinned thermistors 10 with a silver bearing, high temperature solder alloy. This heating pad P was then insulated with high temperature RTV silicone to form the insulating layer 20. The completed heating pad P thus formed had a resistance of 90 ohms at room temperature of approximately 77° F.

Figure 2:
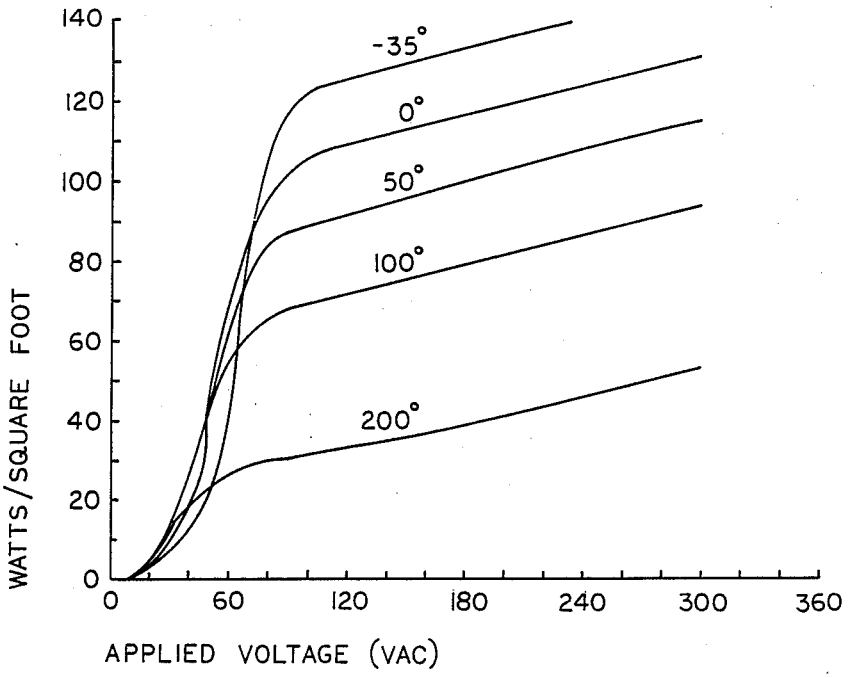
FIG. 2 is a graph illustrating the unit power produced at given temperatures and given voltages for the heating pad of FIG. 1.
Figure 3:
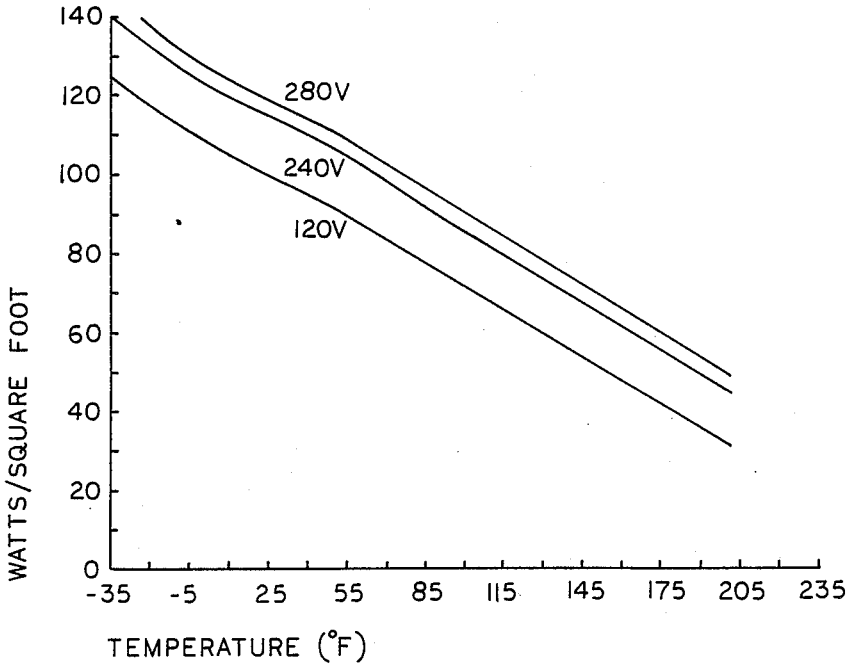
FIG. 3 is a graph representing the unit power produced at given temperatures and given voltages for a heating pad according to FIG. 1.

This heating pad P was then placed in an environmental chamber, and tested at equilibrium temperatures of −35° F., 0° F., 50° F., 100° F., and 200° F. and energized at voltages ranging from 0 to 300 volts. The power consumption at the various voltages and temperatures was recorded and the results are shown in FIGS. 2 and 3. It can thus be seen that the present invention provides a construction which produces high power levels with a given applied voltage before the thermistors reach the self-limiting temperature.

In another test, the same heating pad P was energized by approximately 120 volts while the heating pad P was suspended in a free air environment having a temperature of 76° F. Temperature measurements were taken at a series of locations on the surface of the heating pad P. The maximum and minimum temperatures at positions directly over the thermistors 10 were 199° F. and 178° F. The average temperature directly over the termistors was approximately 183° F. The outer edges of the heating pad P had temperatures of 111° F., 116° F., 112 ° F. and 102° F. The average temperature on the surface area at locations between the thermistors 10 was approximately 121° F., with a maximum of 134° F. and a minimum of 108° F. Such results indicate the efficient heat transfer from the thermistors 10 to the conductive sheets 16, 18 and the good thermal conduction of the conductive sheets 16, 18.

It will be understood that because the heat is generated initially at the thermistors, the pad may be selectively formed or cut into any desired shape while still retaining approximately the same watts per square foot capability for the selected area, assuming an equal area of remaining heating pad per thermistor.

The foregoing disclosure and description of the invention are illustrative and exemplanatory thereof, and various changes in the size, shape and materials as well as in the details of the illustrated construction may be made without departing from the spirit of the invention, and all such changes being contemplated to fall within the scope of the appended claims.

We claim:

1. A flexible electrical heating pad, comprising:

first and second flexible, planar electrical conductor means extending substantially parallel to each other and spaced from each other for conveying electrical current and for conducting heat;

heating means formed of variable electrical resistance heating material electrically connected between said first and second conductor means for producing heat when current flows therethrough, said variable resistance heating material substantially increasing in resistance when a temperature limit is reached to reduce the current flowing through said heating means so as to control the heat output of the heating pad, said heating means including a plurality of chips of said variable resistance heating material, each of said chips having opposed planar surfaces in electrical and thermal contact with respective ones of said conductor means, said chips arranged in a two dimensional array, said total chip area being less than the total area of each of said conductor means, said chips being held in electrical and thermal contact with said conductor means by soldering, brazing, or welding;

flexible, electrical insulating means disposed between those portions of said conductor means not contacted by said heating means for preventing contact between said first and second conductor means;

flexible, electrical insulating material disposed externally of and covering the outer surfaces of said conductor means for preventing short circuit or shock by contact with said conductor means;

wherein each of said conductor means comprises a substantially flat sheet of electrically and thermally conductive material having a planar thermal conductance greater than the planar thermal conductance of said electrical insulating means for preventing contact between said conductor means; and wherein said assembly including both said conductor means, said heating means and both said insulating means is bendable.

2. The heating pad of claim 1, wherein said electrical insulating means comprises an insulating material having openings at spaced intervals in which said variable resistance chips are disposed.

3. The heating pad of claim 2, wherein said openings are substantially uniformly spaced from each other for locating said chips substantially uniformly over the area of the heating pad.

4. The heating pad of claim 1, wherein each of said conductor means comprises woven wire cloth.

5. The heating pad of claim 4, wherein said wire cloth is copper.

6. The heating pad of claim 1, further comprising:

a flexible metallic enclosure formed over said electrical insulating material.

7. The heating pad of claim 6, wherein said metallic enclosure is formed of stainless steel.

8. The heating pad of claim 1, wherein said conductor means comprises a plurality of electrically conductive fibers woven into cloth.

* * * * *